US005211839A

United States Patent [19]

Clausen

[11] Patent Number: 5,211,839

[45] Date of Patent: May 18, 1993

[54] CONTROLLING HYDROGEN PARTIAL PRESSURE TO YIELD 650 ° F.- BOILING RANGE MATERIAL IN AN EBULLATED BED PROCESS

[75] Inventor: Glenn A. Clausen, Nederland, Tex.

[73] Assignee: Texaco Inc., White Plains, N.Y.

[21] Appl. No.: 385,038

[22] Filed: Jul. 26, 1989

[51] Int. Cl.[5] ..... C10G 47/02

[52] U.S. Cl. ..... 208/108; 208/107; 208/153; 208/157; 208/163

[58] Field of Search ..... 208/107, 143, 153, 157, 208/163, 108

[56] References Cited

U.S. PATENT DOCUMENTS

| | | | |
|---|---|---|---|
| Re. 25,770 | 4/1965 | Johanson | 208/213 |
| 3,412,010 | 11/1968 | Alpert et al. | 208/108 |
| 3,681,231 | 8/1972 | Alpert et al. | 208/108 |
| 3,691,066 | 9/1972 | Carruthers et al. | 208/255 |
| 3,773,653 | 11/1973 | Nongbri et al. | 208/212 |
| 4,457,834 | 7/1984 | Caspers | 208/143 |
| 4,551,235 | 11/1985 | Carson | 208/107 |
| 4,684,456 | 8/1987 | Van Driesen et al. | 208/107 |

*Primary Examiner*—Helane E. Myers

*Attorney, Agent, or Firm*—Jack H. Park; Kenneth R. Priem

[57] ABSTRACT

In an ebullated bed process, a nominal 1000° F.+ boiling point vacuum residuum is hydrotreated at a first temperature of 750° F. to 875° F. and total pressure of 1900 psig to 3000 psig. Hydrogen partial pressure is controlled by changing total reactor pressure in the range of 1700 psig to 2300 psig to achieve a selected yield of 650° F.− boiling material.

2 Claims, No Drawings

CONTROLLING HYDROGEN PARTIAL PRESSURE TO YIELD 650 ° F.- BOILING RANGE MATERIAL IN AN EBULLATED BED PROCESS

BACKGROUND OF THE INVENTION

1. Field of the Invention

This invention relates to an improved ebullated bed process. In the improved process hydrogen partial pressure is adjusted by adjusting total reactor pressure to achieve a selected 650° F. minus yield. Individual component yields boiling below 650° F. are also affected to different degrees.

2. Description of Other Relevant Methods in the Field

The ebullated bed process comprises the passing of concurrently flowing streams of liquids or slurries of liquids and solids and gas through a vertically cylindrical vessel containing catalyst. The catalyst is placed in random motion in the liquid and has a gross volume dispersed through the liquid medium greater than the volume of the mass when stationary. The ebullated bed process has found commercial application in the upgrading of heavy liquid hydrocarbons such as vacuum residuum or atmospheric residuum or converting coal to synthetic oils.

The ebullated bed process is generally described in U.S. Pat. Re. No. 25,770 issued Apr. 27, 1965 to E. S. Johanson. In Example 1, a residual hydrocarbon oil having a gravity of 8.3° API is treated at a temperature of 830° F., pressure of 3000 psig and hydrogen supplied at 1000 SCF $H_2$ per barrel of charge stock, to yield a cracked product reduced in sulfur.

U.S. Pat. No. 3,412,010 to S. B. Alpert et al. discloses an ebullated bed process for the production of fuels such as diesel oil. A crude feedstock is passed to an ebullated bed at a temperature of 750° F. to 900° F., pressure of 1000 to 5000 psig with at least 2500 scf/bbl of hydrogen. It was found that with recycle, the yield of naphtha and furnace oil could be adjusted.

U.S. Pat. No. 3,681,231 to S. B. Alpert et al. describes an ebullated bed process wherein a petroleum residuum feed material is treated at a temperature of 600° F. to 900° F., a total pressure of 500 psig to 5000 psig and a hydrogen partial pressure in the range of from about 65% to 95% of the total pressure to yield fuel oils such as diesel oil.

U.S. Pat. No. 3,773,653 to G. Nongbri et al. discloses an ebullated bed process for the production of coker feedstocks. In the process a residuum feed is passed through an ebullated bed of particulate hydrotreating catalyst at a hydrogen partial pressure between 1500 and 3000 psi, temperature between 700° F. and 900° F. and space velocity between 0.3 and 1.5 volume of feed per hour per volume of reactor.

SUMMARY OF THE INVENTION

The invention is an improvement in an ebullated bed process which hydrocracks a nominal 1000° F.+ boiling point vacuum residuum in the presence of a particulate catalyst. The process comprises passing the residual oil along with a hydrogen-containing gas upwardly through a zone of ebullated hydrogenation catalyst at a temperature of 750° F. to 875° F. The total pressure is about 1900 psig to 3000 psig and the space velocity is 0.1 to 1.5 volume of oil per hour per volume of reactor. Hydrogen partial pressure is controlled by changing total reactor pressure in the range of 1700 to 2300 psig to achieve a selected yield of 650° F. minus boiling range material. Each hydrocarbon yield boiling below 650° F. minus is affected in the process simultaneously. The novelty exists in the method of changing the hydrogen partial pressure, since all known ways to change hydrogen partial pressure do not yield the same advantage as when hydrogen partial pressure is varied by changing reactor pressure.

There are four ways to control hydrogen partial pressure: by changing reactor pressure as is disclosed in this application, by changing hydrogen gas rate at constant reactor pressure (see Example 3), by changing hydrogen feed gas purity (see Example 4), or by addition of gas phase material with the feed (addition of light liquid hydrocarbons). Each of these four methods will be discussed in further length in the Examples to follow.

DETAILED DESCRIPTION OF THE INVENTION

During an evaluation of the effects of reactor outlet hydrogen partial pressure when processing a nominal 1000° F.+ boiling point vacuum residuum, it was discovered that raising the reactor pressure increased the yields of all materials boiling below 650° F. and decreased the yield of 650° F. to 1000° F. boiling material without affecting the conversion of 1000° F. plus boiling range material. This invention is better shown by way of Example.

EXAMPLE

In all the following Examples, an ebullated bed system using two reactors in series was employed. The pilot unit used is a nominal 5 barrel per day unit utilizing a pseudo-equilibrated (age distributed) catalyst. Catalyst is replaced at a given rate each day to affect the age distribution. A two-stage system was utilized to give improved hydrogenation activity over a single stage unit, but it not believed to be necessary to affect the observed change in product yields. No interstage separation of gas and liquid was utilized during this study. The feed stock used during this study was obtained from a mixture of vacuum residuum obtained from both domestic and foreign sources. Properties of the feed are shown in Table I. It should be noted that the feed is a nominal 1000° F.+ boiling point vacuum residuum.

Examples 1 and 2 show the affects of varied reactor outlet hydrogen partial pressure accomplished by changing total reactor pressure at two different levels of 1000° F.+ conversion to 1000° F.− material. The reactor pressure was changed by changing the amount of back pressure held on the hydrocracking zone. Note the increase in all light hydrocarbon yields as the outlet hydrogen partial pressure increased. This is unexpected and novel in light of Examples 3 and 4.

A nominal 1000° F.+ boiling point vacuum residuum was chosen for this experiment to obtain a feed typical of commercial operations. It is suspected that lighter feeds such as atmospheric residuum or atmospheric gas oils would not give the same unexpected results seen in Examples 1 and 2. The quantity of 650° F. minus boiling point material in these other feeds could be sufficient to inhibit the observed change in 650° F. minus yield.

TABLE I

| FEED DETAILED DATA SECTION | | |
|---|---|---|
| | TOTAL | 1000° F.+ |
| Gravity, API (ASTM D-287) | 5.1 | 4.8 |

TABLE I-continued

| FEED DETAILED DATA SECTION | TOTAL | 1000° F.+ |
|---|---|---|
| X-Ray Sulfur, wt % (ASTM D-4294) | 4.60 | 4.64 |
| Carbon Residue, wt % (ASTM D-189) | 22.85 | 23.56 |
| Total Nitrogen, wppm (Chemiluminescence) | 3767 | 3857 |
| CHN Analysis, wt % (LECO Combustion Analysis) | | |
| Carbon | 85.3 | |
| Hydrogen | 10.2 | |
| Nitrogen | .9 | |
| Metals, wppm | | |
| V | 92.8 | 96.8 |
| NI | 33.4 | 34.9 |
| FE | 8.6 | 19.4 |
| CR | .5 | .5 |
| NA | 11.4 | 11.9 |
| Ash, wt % (ASTM D-482) | .02 | |
| Pentane Insolubles, wt % (by solvent extraction) | 22.10 | |
| Heptane Insolubles, wt % (by solvent extration) | 8.17 | |
| Toluene Insolubles, wt % (by solvent extraction) | .09 | |
| Asphaltenes, wt % (by substraction) | 8.08 | |
| Kinematic Viscosity, CST (ASTM D-445) | | |
| @ 212 Deg F. | 1948.0 | |
| @ 250 Deg F. | 500.0 | |
| @ 30 Deg F. | 135.0 | |

Explanation of Abbreviations
API = American Petroleum Institute
wt % = weight percent
wppm = weight parts per million
CST = centistokes
Deg F. = degrees Fahrenheit

EXAMPLE 1
COMPARISON OF YIELDS AT LOW CONVERSION

| Run Number | 1228D | | 1228S | |
|---|---|---|---|---|
| Number of Stages | 2 | | 2 | |
| Operating Conditions | | | | |
| Avg RX Temp., Deg F. | 781 | | 780 | |
| LHSV, V/Hr/V | .30 | | .30 | |
| $H_2$ Partial Pressure | | | | |
| Inlet, psia | 2526 | | 1971 | |
| Outlet, psia | 2276 | | 1795 | |
| Gas Rates, SCFB | TOTAL | $H_2$ | TOTAL | $H_2$ |
| Make-up Gas | 6903 | 6903 | 6649 | 6649 |
| Reactor Conditions | RX1 | RX2 | RX1 | RX2 |
| Avg Rx Temp., Deg F. | 782 | 779 | 780 | 780 |
| 1000+°F. Conv., Vol % | 41.9 | | 43.5 | |
| Material Balance | WT % | | WT % | |
| $NH_3$, Ammonia | .14 | | .06 | |
| $H_2S$, Hydrogen Sulfide | 3.86 | | 3.24 | |
| $H_2$, Hydrogen | −1.26 | | −1.10 | |
| $C_1$, Methane | .97 | | .80 | |
| $C_2$, Ethane | .76 | | .64 | |
| $C_3$, Propane | .95 | | .72 | |
| $iC_4$, Isobutane | .07 | | .03 | |
| $nC_4$, Normal Butane | .79 | | .47 | |
| $iC_5$, Isopentane | .23 | | .11 | |
| $nC_5$, Normal Pentane | .48 | | .24 | |
| IBP-180° F. | .59 | | .48 | |
| 180-360° F. | 4.54 | | 3.81 | |
| 360-650°F. | 12.33 | | 10.36 | |
| 650° F. Minus | 21.71 | | 17.66 | |
| 650-1000° F. | 29.24 | | 30.62 | |

-continued

EXAMPLE 1
COMPARISON OF YIELDS AT LOW CONVERSION

| Reactor 2 Outlet Pressure, psig | 2489 | 1935 |
|---|---|---|

Explanation of Abbreviations
Deg F. = degrees Fahrenheit
SCFB = standard cubic feet per barrel of fresh feed
V/Hr/V = volume of oil/hour/volume of reactor
psia = pounds per square inch absolute
psig = pounds per square inch gauge
Vol % = volume percent
Rx1 = reactor one
Rx2 = reactor two
WT % = weight percent

EXAMPLE 2
COMPARISON OF YIELDS AT HIGHER CONVERSION

| Run Number | 1229A | | 1229L | |
|---|---|---|---|---|
| Number of Stages | 2 | | 2 | |
| Operating Conditions | | | | |
| Avg Rx Temp., Deg F. | 788 | | 791 | |
| LHSV, V/Hr/V | .301 | | .303 | |
| $H_2$ Partial Pressure | | | | |
| Inlet, psia | 2525 | | 2176 | |
| Outlet, psia | 2251 | | 1929 | |
| Gas Rates, SCFB | TOTAL | $H_2$ | TOTAL | $H_2$ |
| Make-up Gas | 6659 | 6659 | 6569 | 6569 |
| Reactor Conditions | RX1 | RX2 | RX1 | RX2 |
| Avg Rx Temp., Deg F. | 787 | 790 | 792 | 789 |
| 1000+° F. Conv., Vol % | 53.6 | | 53.3 | |
| Material Balance | WT % | | WT % | |
| $NH_3$, Ammonia | .13 | | .10 | |
| $H_2S$, Hydrogen Sulfide | 3.78 | | 3.45 | |
| $H_2$, Hydrogen | −1.03 | | −1.51 | |
| $C_1$, Methane | 1.16 | | 1.01 | |
| $C_2$, Ethane | .88 | | .81 | |
| $C_3$, Propane | 1.07 | | .95 | |
| $iC_4$, Isobutane | .09 | | .08 | |
| $nC_4$, Normal Butane | .84 | | .83 | |
| $iC_5$, Isopentane | .20 | | .18 | |
| $nC_5$, Normal Pentane | .36 | | .36 | |
| IBP-180° F. | 1.18 | | .80 | |
| 180-360° F. | 5.68 | | 5.16 | |
| 360-650° F. | 15.65 | | 13.62 | |
| 650° F. Minus | 27.11 | | 23.80 | |
| 650-1000° F. | 29.78 | | 33.09 | |
| Reactor 2 Outlet Pressure, psig | 2489 | | 2140 | |

Explanation of Abbreviations
Deg F. = degrees Fahrenheit
SCFB = standard cubic feet per barrel of fresh feed
V/Hr/V = volume of oil/hour/volume of reactor
psia = pounds per square inch absolute
psig = pounds per square inch gauge
Vol % = volume percent
Rx1 = reactor one
Rx2 = reactor two
WT % = weight percent Example 3 shows the affects of changing hydrogen partial pressure by changing gas rates. If hydrogen partial pressure is decreased by decreasing gas rate, the same effect on yields is not observed. Lowering the gas rate in the ebullated bed reactor can decrease the hold-up of gas in the reactor and increase the liquid residence time, thus allowing liquid phase material to further crack to 650° F. minus material. Hence, in the ebullated bed process, the mode by which hydrogen partial pressure is changed unexpectedly affects the resulting product yields.

EXAMPLE 3
COMPARISON AT VARIED GAS RATE

| Run Number | 1229Y | 1229Z |
|---|---|---|
| Number of Stages | 2 | 2 |
| Operating Conditions | | |

-continued

EXAMPLE 3
COMPARISON AT VARIED GAS RATE

| | | | | |
|---|---|---|---|---|
| Avg Rx Temp., Deg F. | 800 | | 800 | |
| LHSV, V/Hr/V | .309 | | .307 | |
| $H_2$ Partial Pressure | | | | |
| Inlet, psia | 2394 | | 2519 | |
| Outlet, psia | 2011 | | 1935 | |
| Gas Rates, SCFB | TOTAL | $H_2$ | TOTAL | $H_2$ |
| Make-up Gas | 5539 | 5539 | 4417 | 4417 |
| Reactor Conditions | RX1 | RX2 | RX1 | RX2 |
| Avg Rx Temp., Deg F. | 800 | 800 | 800 | 800 |
| 1000+° .F Conv., Vol % | 62.4 | | 63.1 | |
| Material Balance | WT % | | WT % | |
| $NH_3$, Ammonia | .12 | | .11 | |
| $H_2S$, Hydrogen Sulfide | 3.46 | | 3.55 | |
| $H_2$, Hydrogen | −1.49 | | −1.94 | |
| $C_1$, Methane | 1.13 | | 1.12 | |
| $C_2$, Ethane | 98 | | 1.05 | |
| $C_3$, Propane | 1.17 | | 1.29 | |
| $iC_4$, Isobutane | .16 | | .26 | |
| $nC_4$, Normal Butane | .90 | | .97 | |
| $iC_5$, Isopentane | .26 | | .30 | |
| $nC_5$, Normal Pentane | .52 | | .55 | |
| IBP–180° F. | 1.04 | | 1.04 | |
| 180–360° F. | 6.78 | | 7.02 | |
| 360–650° F. | 16.35 | | 15.85 | |
| 650° F. Minus | 29.29 | | 29.45 | |
| 650–1000° F. | 35.28 | | 35.97 | |
| Reactor 2 Outlet Pressure, psig | 2339 | | 2460 | |

Explanation of Abbreviations
Deg F. = degrees Fahrenheit
SCFB = standard cubic feet per barrel of fresh feed
V/Hr/V = volume of oil/hour/volume of reactor
psia = pounds per square inch absolute
psig = pounds per square inch gauge
Vol % = volume percent
WT % = weight percent Example 4 shows the affects of changing hydrogen partial pressure by changing hydrogen gas purity. If hydrogen gas purity is reduced, total gas rate must increase to maintain a constant hydrogen partial pressure. Gas hold-up can increase and gas yields decrease. If hydrogen sulfide is introduced as in Example 4, additional hydrogenation results due to hydrogen donor activity of the hydrogen sulfide. This results in additional 650° F. minus material at the expense of unconverted vacuum residuum instead of at the expense of 650°–1000° F. boiling range material as seen in Examples 1 and 2.

EXAMPLE 4
COMPARISON AT VARIED HYDROGEN PURITY

| | | | | |
|---|---|---|---|---|
| Run Number | 1231H | | 863116 | |
| Number of Stages | 2 | | 2 | |
| Operating Conditions | | | | |
| Avg Rx Temp., Deg F. | 800 | | 800 | |
| LHSV, V/Hr/V | .274 | | .275 | |
| $H_2$ Partial Pressure | | | | |
| Inlet, psia | 2438 | | 2574 | |
| Outlet, psia | 2176 | | 2181 | |
| Gas Rates, SCFB | TOTAL | $H_2$ | TOTAL | $H_2$ |
| Make-up Gas | 6801 | 6801 | 2457 | 2457 |
| Rx Feed Gas | 3568 | 3568 | 4326 | 3987 |
| Recycle Gas | | | 3962 | 3458 |
| Reactor Conditions | RX1 | RX2 | RX1 | RX2 |
| Avg Rx Temp., Deg F. | 801 | 799 | 798 | 801 |
| 1000+° F. Conv., Vol % | 54.2 | | 58.0 | |
| Material Balance | WT % | | WT % | |
| $NH_3$, Ammonia | .28 | | .32 | |
| $H_2S$, Hydrogen Sulfide | 3.16 | | 3.20 | |
| $H_2$, Hydrogen | −1.27 | | −2.01 | |

-continued

EXAMPLE 4
COMPARISON AT VARIED HYDROGEN PURITY

| | | |
|---|---|---|
| $C_1$, Methane | 1.28 | 1.02 |
| $C_2$, Ethane | .89 | .84 |
| $C_3$, propane | 1.05 | 1.12 |
| $iC_4$, Isobutane | .08 | .21 |
| $nC_4$, Normal Butane | .85 | .89 |
| $iC_5$, Isopentane | .19 | .29 |
| $nC_5$, Normal Pentane | .36 | .54 |
| IBP–180° F. | .31 | .44 |
| 180–360° F. | 4.63 | 7.13 |
| 360–650° F. | 20.80 | 21.35 |
| 650° F. Minus | 30.44 | 33.83 |
| 650–1000° F. | 27.59 | 27.11 |
| Reactor 2 Outlet Pressure, psig | 2400 | 2763 |

Explanation of Abbreviations
Deg F = degrees Fahrenheit
SCFB = standard cubic feet per barrel of fresh feed
V/Hr/V = volume of oil/hour/volume of reactor
psia = pounds per square inch absolute
psig = pounds per square inch gauge
Vol % = volume percent
Rx1 = reactor one
Rx2 = reactor two
WT % = weight percent The fourth way to affect hydrogen partial pressure is to add light liquid material to the feed which vaporizes or cracks into the gas phase at reactor conditions. This method was not pursued, since light hydrocarbon added to the residuum feed can cause precipitation of asphaltenic type materials and hence unacceptable products. Lighter aromatic diluants are sometimes added to the feed to prevent precipitation of asphaltic materials, however these diluents do not form a high percentage of vapor phase material at typical operating conditions thus they do not change the hydrogen partial pressure to a great degree.

What is claimed is:

1. A method for hydrocracking a nominal 1000° F.+ boiling point vacuum residuum by treating the oil with hydrogen in the presence of a particulate catalyst in an ebullated bed, the steps comprising:

passing the residual oil, and a hydrogen-containing gas upwardly through an ebullated bed of catalyst in a hydrocracking zone at a temperature in the range of 750° F. to 875° F. and a total pressure in the range of about 1900 psig to 3000 psig, changing the partial pressure of hydrogen in the range of 1700 psig to 2300 psig by adjusting the total reactor pressure to change the quantity of 650° F.− boiling material which increases as outlet hydrogen partial pressure increases without changing the yield of unconverted 1000° F.+ boiling range material.

2. A method for hydrocracking a nominal 1000° F.+ boiling point vacuum residuum by treating the oil with hydrogen in the presence of a particulate catalyst in an ebullated bed, the steps comprising:

passing the residual oil, and a hydrogen-containing gas upwardly through an ebullated bed of catalyst in a hydrocracking zone at a temperature in the range of 750° F. to 875° F. and a total pressure in the range of about 1900 psig to 3000 psig, changing the partial pressure of hydrogen in the range of 1700 psig to 2300 psig by adjusting the total reactor pressure to change the quantity of 650° F.− boiling material produced in the range of 27.11 wt % to 17.66 wt % without changing the yield of unconverted 1000° F.+ boiling range material.

* * * * *